United States Patent [19]

Hanson

[11] Patent Number: 4,931,911

[45] Date of Patent: Jun. 5, 1990

[54] NONREMOVABLE WALL-MOUNTED NIGHT LIGHT ASSEMBLY

[76] Inventor: Curtis O. Hanson, 102 E. 1st Ave., Post Falls, Id. 83854

[21] Appl. No.: 452,798

[22] Filed: Dec. 18, 1989

[51] Int. Cl.[5] ..... F21V 33/00

[52] U.S. Cl. ..... 362/95; 362/226; 362/183

[58] Field of Search ..... 362/226, 95, 183

[56] References Cited

U.S. PATENT DOCUMENTS

| | | | |
|---|---|---|---|
| 2,813,265 | 11/1957 | Finks | 362/183 |
| 3,196,266 | 7/1965 | Grosser | 362/226 |
| 3,218,448 | 11/1965 | Cala | 362/226 |
| 3,900,725 | 8/1975 | Komon | 362/226 |

FOREIGN PATENT DOCUMENTS

| | | | |
|---|---|---|---|
| 672195 | 10/1963 | Canada | 362/95 |

*Primary Examiner*—James C. Yeung

*Attorney, Agent, or Firm*—Chernoff, Vilhauer, McClung & Stenzel

[57] ABSTRACT

A night light assembly which is adapted to be secured to an electrical outlet box includes, in combination, a night light having an illuminating end and a connecting end joined at 90° with respect to one another, where the connecting end includes a pair of prongs for connection to a standard electrical outlet disposed within an outlet box recessed into a wall, and an electrical outlet cover plate for connecting to the electrical outlet box which includes a U-shaped receiving flange for fixedly holding the night light in a predetermined relation to the electrical outlet when the cover plate is attached to the outlet box.

6 Claims, 1 Drawing Sheet

NONREMOVABLE WALL-MOUNTED NIGHT LIGHT ASSEMBLY

The following invention relates to a night light assembly which is fixedly attached to an electrical wall outlet cover plate such that the night light cannot be independently removed from the outlet.

Commercial establishments and in particular, hotels, inns and guest houses, have a need for providing night lights in their guest rooms. Most commercially available nightlights are small electric lights which have a connecting end including a pair of prongs for plugging into a standard wall outlet and an illuminating end containing a light bulb extending at 90° to the connecting end. These lights are intended to be simply plugged into and removed from standard wall outlets by the user as needed. The problem with providing such night lights in a commercial establishment is that these small items are of the type that patrons frequently remove from the premises. It is too expensive to supply night lights as fungible items such as soap or shampoo which are expected to be replaced each time the room is used. One solution to this problem might be to build night lights into each room's lighting circuit, but for older establishments the cost would be prohibitive.

Night lights are also often used in children's rooms but are unsafe due to the fact that they can be removed with the attendant danger of a child's touching the prongs and receiving an electric shock.

What is needed, therefore, is a night light fixture which can be permanently affixed to a standard wall outlet so that the night light itself is nonremovable.

SUMMARY OF THE INVENTION

The present invention comprises a night light assembly which is adapted to be secured to an electrical outlet box and includes, in combination, a night light having an illuminating end and a connecting end joined at 90° with respect to one another, where the connecting end includes a pair of prongs for connection to a standard electrical outlet disposed within an outlet box recessed into a wall, and an electrical outlet cover plate for connecting to the electrical outlet box which. includes a U-shaped receiving flange for fixedly holding the night light in a predetermined relation to the electrical outlet when the cover plate is attached to the outlet box.

The receiving flange may include a protruding bottom wall and a pair of side walls for frictionally engaging the connecting end of the night light which may be held upright within the cup-like enclosure formed by the flange with glue or adhesive such as epoxy cement of a type suitable for joining plastic members together. An upper wall of the flange extends across a portion of the illuminating end of the night light, forming a stop which regulates the penetration depth of the prongs into the electrical outlet, and assures the proper distance between the night light and the outlet for proper electrical contact. The walls of the receiving flange may also include compression ribs for frictionally engaging the connecting end of the night light.

It is a primary object of this invention to provide a nonremovable night light fixture which can be fixedly attached to a standard electrical wall outlet box wherein the night light portion of the assembly cannot be removed.

DETAILED DESCRIPTION OF THE DRAWINGS

Figure 2:
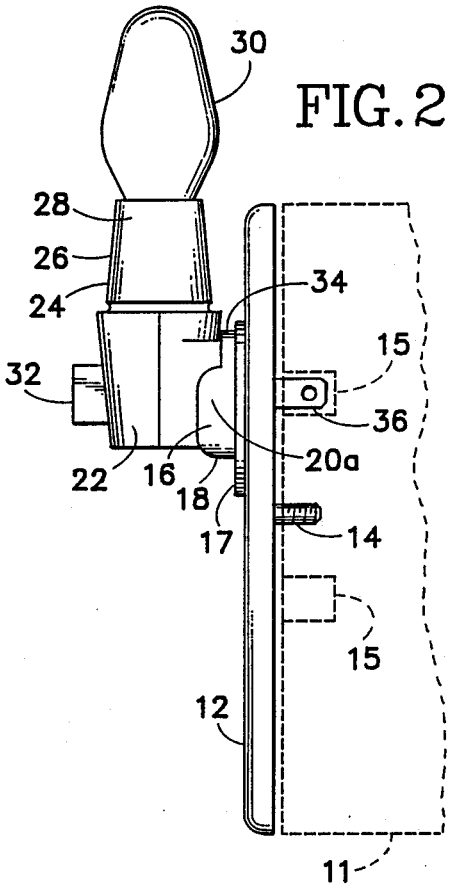
FIG. 2 is a side view of the night light assembly of FIG. 1.

A night light assembly 10 includes a cover plate 12 having fasteners such a screw 14 for connection to a standard electrical wall outlet box 11 (shown in phantom outline in FIG. 2). The plate 12 includes an aperture 13 for permitting access to electrical outlets 15. The cover plate 12 includes an integral lip or receiving flange 16 projecting from an outlet cover 17 having a bottom wall 18 and a pair of side walls **20*a* and 20*b* for holding the connecting end 22 of a night light 24**.

Figure 3:
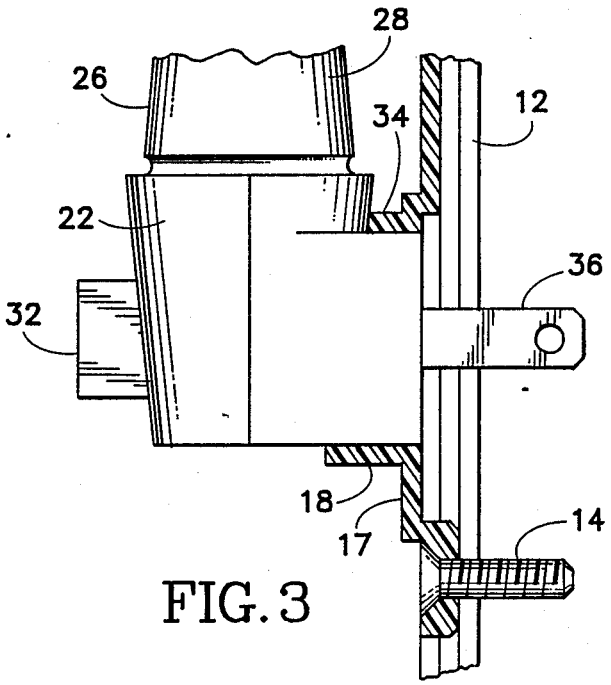
FIG. 3 is a partial cutaway side view taken along line 3—3 of FIG. 1.

The night light 24 also includes an illuminating end 26 comprising a base 28 and a bulb 30. A switch 32 turns the bulb 30 on and off. The illuminating end 26 extends at a 90° angle to the connecting end 22 so that when the night light 24 is held within the flange 16 it is oriented in a vertically upright direction. This is the standard configuration for most wall outlets. The connecting end 22 is frictionally held by the walls 18 and **20*a* and 20*b*. An adhesive such as glue or epoxy of a type suitable for use with plastic parts may be applied to make this connection permanent. In addition, the side wall portions of the flange 16 may include compressing ribs which engage the connecting portion to hold it in place. The connecting end of the night light 24 slides into the receptacle 16 until the illuminating end 26 is stopped by an upper flange wall 34 (shown best in FIG. 3) which regulates the depth of penetration of electrical prongs 36 into the electrical outlet 15. This ensures that the prongs 36 make a secure connection without extending too far into the outlet box 11. The side walls 20*a* and 20*b* together with the bottom wall 18 protrude farther from the plane of plate 12 than top wall 34 forming a U-shaped lip in order to provide support for holding the night light 24** securely and in an upright position.

Figure 1:
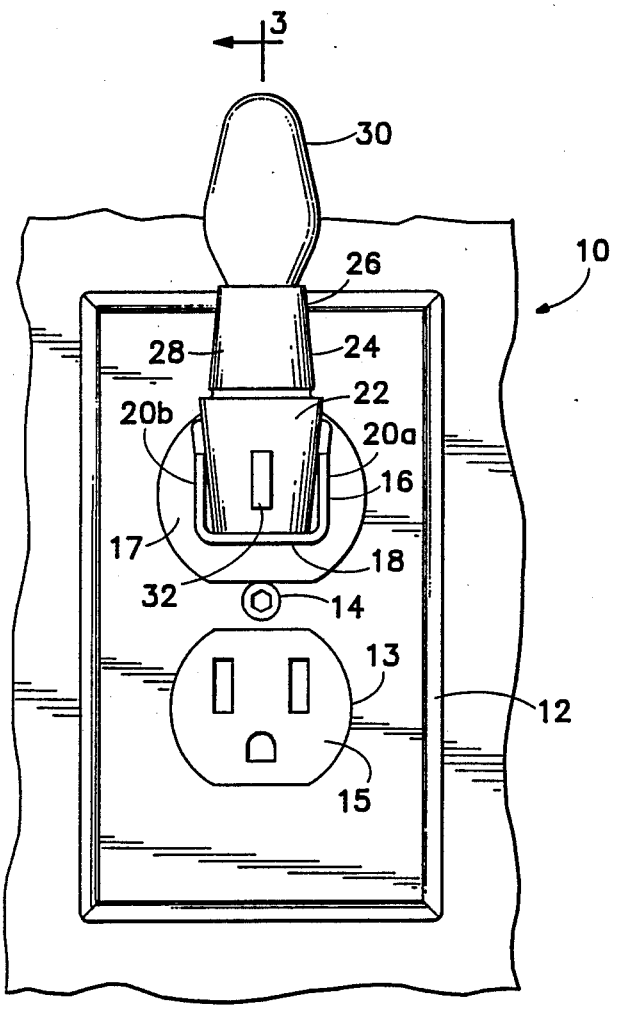
FIG. 1 is a front view of the night light assembly of the present invention.

As best shown in FIG. 1, the side walls **20*a* and 20*b* flare slightly outwardly toward their intersection with top wall 34 to create an irregular opening. This flare is to accommodate a corresponding flare in the shape of connecting end 22 so that the night light 24** can only be inserted one way. This feature helps to ensure that lights will not be inserted with incorrect orientation during the manufacturing process.

With the night light 24 glued to the cover plate 12, the cover plate may then be simply affixed to the outlet box 11 by means of the screws 14 and the prongs 36 will automatically plug into the outlet 15 in the outlet box 11 at the correct depth. Thereafter the night light cannot be removed from the outlet 11 in the normal manner because it is permanently affixed to the receiving flange 16.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A nonremovable night light assembly adapted for attachment to an electrical outlet box comprising, in combination:

(a) an electric night light comprising an illuminating end and a connecting end, said ends disposed at a 90° angle to one another, said connecting end including a pair of prongs for connecting to an electrical outlet disposed within said outlet box; and (b) an electrical outlet cover comprising a generally planar plate having fastening means for connecting said cover to said outlet box and including a receiving flange for fixedly holding said night light therein in predetermined relation to said electrical outlet when said cover plate is attached to said outlet box wherein said receiving flange includes a bottom wall and a pair of side walls for frictionally engaging said connecting end of said night light, and an upper wall extending across a portion of said illuminating end forming a stop for regulating the penetration depth of said prongs into said electrical outlet.

2. The night light assembly of claim 1 wherein said pair of side walls have a slight outward flare towards said upper wall thereby defining an irregular opening for said connecting end of said night light.

3. The night light assembly of claim 1 wherein said night light is held within said receiving flange by an adhesive.

4. The night light assembly of claim 1 wherein said bottom and side walls protrude farther from said cover plate than said top wall to form a U-shaped lip to provide support for said connecting end along the side and bottom thereof.

5. A one-piece night light assembly comprising a cover plate portion having at least one aperture for receiving fastening means for fastening said assembly to an AC wall outlet fixture having an AC receptacle, and a nonremoveable night light portion integral with said cover plate portion having prongs extending laterally of the cover plate portion in a first direction for making an electrical connection to said receptacle, said night light portion having an illuminating end spaced laterally in a second direction from the cover plate, said night light portion being positioned relative to said cover plate portion such that said prongs extend a distance sufficient to make proper electrical connection with said receptacle when said cover plate portion is fastened to said AC wall outlet fixture.

6. The one piece nonremovable night light assembly of claim 5 wherein said cover plate portion and said night light portion are held together by an adhesive.

* * * * *